US009776432B2

(12) United States Patent
Mimoto et al.

(10) Patent No.: US 9,776,432 B2
(45) **Date of Patent: *Oct. 3, 2017**

(54) IMAGE RECORDING APPARATUS

(71) Applicant: Brother Kogyo Kabushiki Kaisha, Nagoya-shi, Aichi-ken (JP)

(72) Inventors: Masao Mimoto, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/185,702

(22) Filed: Jun. 17, 2016

(65) Prior Publication Data

US 2017/0008309 A1 Jan. 12, 2017

Related U.S. Application Data

(63) Continuation of application No. 14/866,079, filed on Sep. 25, 2015, now Pat. No. 9,381,754.

(30) Foreign Application Priority Data

Sep. 25, 2014 (JP) ..... 2014-194542

(51) Int. Cl.

| | |
|---|---|
| ***B41J 11/00*** | (2006.01) |
| ***B65H 29/70*** | (2006.01) |
| ***B65H 5/38*** | (2006.01) |
| ***B41J 2/04*** | (2006.01) |

(Continued)

(52) U.S. Cl.

CPC ..... *B41J 11/005* (2013.01); *B41J 2/04* (2013.01); *B41J 11/0045* (2013.01); *B41J 13/03* (2013.01); *B41J 13/14* (2013.01); *B65H 5/38* (2013.01); *B65H 29/70* (2013.01);

(Continued)

(58) Field of Classification Search

CPC ..... B41J 13/0009; B41J 15/04; B41J 29/38; B41J 11/0045; B41J 2/04; B41J 13/03; B41J 13/14; B41J 11/005; B41H 29/393; B65H 5/38; B65H 29/70

See application file for complete search history.

(56) References Cited

U.S. PATENT DOCUMENTS

| | | | |
|---|---|---|---|
| 5,579,039 A | 11/1996 | Kurata et al. | |
| 6,038,424 A | 3/2000 | Nakagawa | |
| 9,381,754 B2 * | 7/2016 | Mimoto | B41J 11/005 |

FOREIGN PATENT DOCUMENTS

| | | |
|---|---|---|
| JP | 2000-071532 A | 3/2000 |

* cited by examiner

*Primary Examiner* — Lamson Nguyen
(74) *Attorney, Agent, or Firm* — Banner & Witcoff, Ltd.

(57) ABSTRACT

An image recording apparatus includes: a recording section which records an image on a sheet conveyed in a conveyance direction in a conveyance route; a first abutment member having a plurality of first abutment portions arranged apart from each other in a width direction orthogonal to the conveyance direction, and configured to abut against the sheet conveyed in the conveyance route; a first supporting member which supports the first abutment member; and a plurality of second abutment members which are supported by the first supporting member at both sides in the width direction, respectively, of the first abutment member, at a distance from the first abutment member, and each of which has a second abutment portion capable of contacting with the sheet conveyed in the conveyance route.

12 Claims, 10 Drawing Sheets

(51) Int. Cl.
*B41J 13/03* (2006.01)
*B41J 13/14* (2006.01)

(52) U.S. Cl.
CPC *B65H 2301/5122* (2013.01); *B65H 2404/611* (2013.01); *B65H 2404/62* (2013.01)

IMAGE RECORDING APPARATUS

CROSS REFERENCE TO RELATED APPLICATION

The present application is a continuation of prior U.S. application Ser. No. 14/866,079, filed Sep. 25, 2015, which claims priority from Japanese Patent Application No. 2014-194542 filed on Sep. 25, 2014 the disclosure of which is incorporated herein by reference in its entirety.

BACKGROUND

Field of the Invention

The present invention relates to an image recording apparatus wherein a plurality of abutment portions abut against a sheet which is being conveyed in a conveyance route.

Description of the Related Art

Conventionally, there is known an ink-jet recording apparatus which jets ink droplets toward a sheet from nozzles provided in a recording unit so as to record an image, etc. on the sheet. In the ink-jet recording apparatus, the sheet which is being conveyed in a conveyance route formed inside the apparatus sometimes floats from a member supporting the sheet. Such a floating of the sheet easily occurs particularly at both end portions in the width direction of the sheet. Further, if the floating of the sheet occurs at a position facing the recording unit, the distance between the sheet and the recording unit might be changed and the quality of image, etc. recorded on the sheet might be adversely affected.

In order to solve such a problem, there has been conventionally known an image recording apparatus including a plurality of projections and recesses alternately formed along a conveyance direction in which a sheet is conveyed so that the sheet is moved on the platen in a waved state in which the sheet is waved in a width direction of the sheet orthogonal to the conveyance direction. Specifically, a plurality of ribs which are parallel to the conveyance direction are arranged in a conveyance surface of the platen, and a plurality of abutment portions which abut against the sheet are arranged between the plurality of ribs, respectively.

Provided that the plurality of abutment portions are integrally molded of a synthetic resin, then, in a case that a sheet is conveyed on the platen, the plurality of abutment portions are moved together due to abutment against the sheet. In this configuration, if a sheet which is relatively short in the width direction is conveyed on the platen, some abutment portions which do not abut against the sheet are also moved, which in turn increases load on the sheet. As a result, the conveyance resistance of the sheet is increased, the conveyance precision might be varied (fluctuated), and the load on a motor driving a sheet-conveying roller might be increased.

On the other hand, in a case that the plurality of abutment portions are molded independently of a synthetic resin as separate abutment portions, positions at which the sheet is pressed by the respective abutment portions are varied due to any variation during the molding of the respective abutment portions. For example, in such a case that a plurality of abutment portions having the same shape are arranged in the width direction, the abutment portions having any variations in the molding are arranged and attached in the width direction, and thus a waving shape imparted to the sheet during the conveyance is also varied depending on the apparatuses. In a case that there is any variation in the waving shape of the sheet, the landing positions of the ink (ink droplets) discharged from the recording head onto the sheet are also varied, which in turn might lower the precision or accuracy of a recorded image.

The present teaching has been made in view of the above-described circumstances; an object of the present teaching is to provide an image recording apparatus, in which a plurality of abutment portions abut against a sheet being conveyed in a conveyance route without imparting any excessive load on the sheet and in which any variation in abutment positions of the abutment portions hardly occurs.

SUMMARY

According to an aspect of the present teaching, there is provided an image recording apparatus including: a recording section configured to record an image on a sheet conveyed in a conveyance direction in a conveyance route; a first abutment member having a plurality of first abutment portions arranged apart from each other in a width direction orthogonal to the conveyance direction, and configured to abut against the sheet conveyed in the conveyance route; a first supporting member configured to support the first abutment member; and a plurality of second abutment members supported by the first supporting member at both sides in the width direction, respectively, apart from the first abutment member, and each having at least one second abutment portion configured to abut against the sheet conveyed in the conveyance route.

Since the first abutment member and the second abutment members are arranged separately and independently from each other, no load is imparted to the at least one second abutment portion during a conveyance of a sheet which makes contact only with the first abutment portions. Further, since the plurality of first abutment portions are provided in the first abutment member, any variation hardly occurs in abutment positions, of the plurality of first abutment portions, at which the first abutment portions abut against the sheet, respectively.

According to the present teaching, in the image recording apparatus in which the plurality of first abutment portions abut against the sheet, the abutment of the first abutment portions against the sheet does not apply any excessive load to the sheet, and any variations in the abutment positions of the first abutment portions hardly occurs.

DESCRIPTION OF THE EMBODIMENTS

Figure 1:
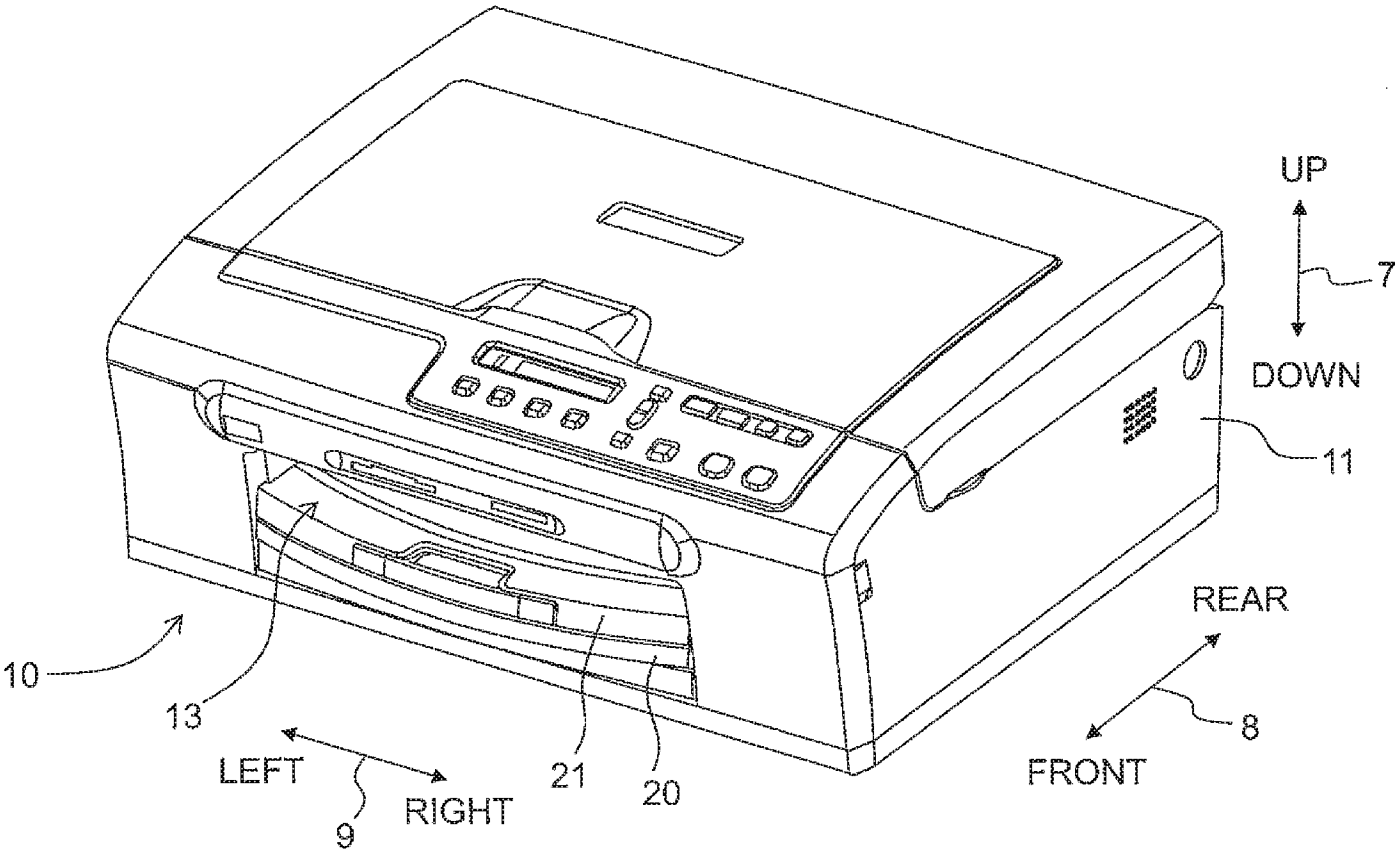
FIG. 1 is a perspective view of a multifunction peripheral as an example of an embodiment of the present teaching.

In the following, an embodiment of the present teaching will be explained with reference to the drawings as appropriate. It is needless to say that the embodiment to be explained below is merely an example of the present teaching, and that it is possible to appropriately change the embodiment of the present teaching without departing from the gist and scope of the present teaching. In the following explanation, an up-down direction 7 is defined with a state that a multifunction peripheral 10 is usably placed (usable state; state depicted in FIG. 1), as the reference, a front-rear direction 8 is defined such that a side on which an opening 13 of the multifunction peripheral 10 is provided is the frontward side (front surface or front side), and a left-right direction 9 is defined as viewing the multifunction peripheral 10 from the frontward side (front surface).

<Entire Structure of Multifunction Peripheral 10>

As depicted in FIG. 1, the multifunction peripheral 10, as an example of an image recording apparatus of the present teaching, is formed to have a substantially rectangular parallelepiped shape of a thin type. A printer unit 11 is provided in a lower portion of the multifunction peripheral 10. The multifunction peripheral 10 has various functions such as a facsimile function and a print function. As the print function, the multifunction peripheral 10 has a function of recording an image, etc., on one surface of a recording paper 12 (see FIG. 2) by an ink-jet recording system. Note that the multifunction peripheral 10 may have a function of recording an image, etc., on both surfaces of the recording paper 12.

<Feeding Tray 20>

Figure 2:
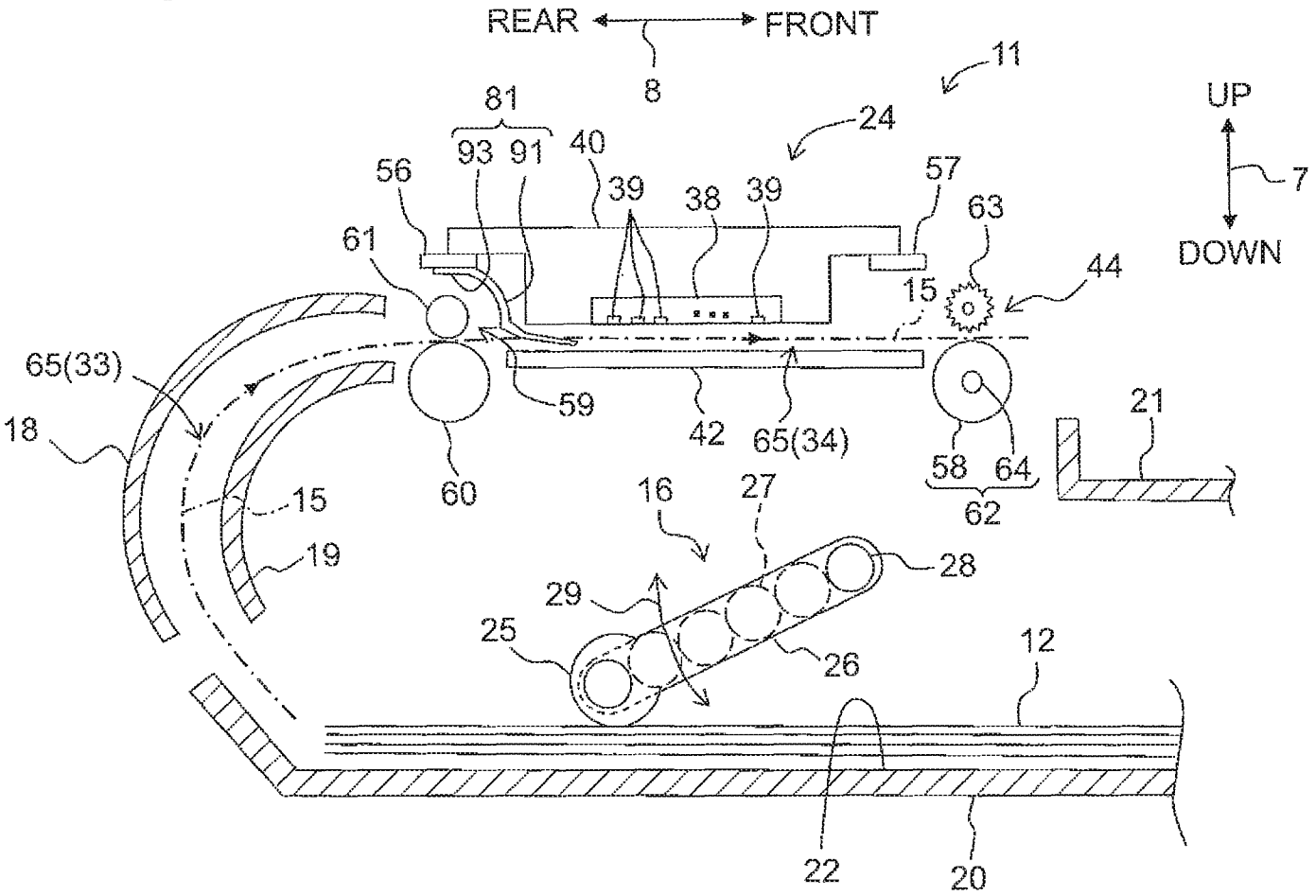
FIG. 2 is a vertical cross-sectional view schematically depicting the internal structure of a printer unit.

As depicted in FIG. 1, the opening 13 is formed in the front surface of the printer unit 11. A feeding tray 20 is insertable into and removable from the multifunction peripheral 10 via the opening 13, by moving the feeding tray 20 in the front-rear direction 8. The feeding tray 20 is a box-shaped member which is open at the upper side thereof. As depicted in FIG. 2, a plurality of sheets of the recording paper 12 is placed in a stacked state on a bottom plate 22 of the feeding tray 20. A discharge tray 21 is supported at a position in front of and above the feeding tray 20. The discharge tray 21 is moved in the front-rear direction 8 integrally with the feeding tray 20. A recording paper 12, on which an image is recorded by a recording unit 24 (to be described later on), is discharged onto the upper surface of the discharge tray 21.

A pair of side guides (not depicted in the drawings) movable in the left-right direction 9 is supported by the bottom plate 22 of the feeding tray 20. The side surfaces of the respective side guides make contact with the left and right end portions, respectively, of a recording paper 12 placed on the bottom plate 22. When one of the pair of side guides is moved in one direction in the left-right direction 9, the other of the pair of side guides is moved in the other direction of the left-right direction 9, as being linked with the movement of the one of the pair of side guides. As described above, in the present embodiment, the recording paper 12 which is placed on the feeding tray 20, which is conveyed in a conveyance route 65 (to be described later on), and on which an image is recorded by the recording section 24 is positioned with the central portion of the conveyance route 65 in the left-right direction 9 as the reference. Namely, the feeding tray 20 supports the recording paper 12 with the center in the left-right direction 9 as the reference position.

<Feeding Section 16>

As depicted in FIG. 2, the feeding section 16 is disposed above the feeding tray 20 in a state of being inserted into the printer unit 11 and below the recording section 24. The feeding section 16 includes a feeding roller 25, a feeding arm 26, a driving transmitting mechanism 27, and a shaft 28. The feeding roller 25 is rotatably supported by the feeding arm 26 at a front end thereof. The feeding arm 26 rotates in a direction indicated by an arrow 29 in FIG. 2, with the shaft 28 disposed at the base end thereof as the rotating center. With this, the feeding roller 25 is capable of contacting with and separating away from the feeding tray 20 or the recording paper 12 supported by the feeding tray 20.

The feeding roller 25 is rotated by the driving force of a conveyance motor (not depicted in the drawings) which is transmitted from the conveyance motor to the feeding roller 25 by the driving transmitting mechanism 27 constructed of a plurality of gears intermeshed with each other. With this, the feeding roller 25 makes contact with an uppermost recording paper 12, of the plurality of sheets of the recording paper 12 placed on the bottom plate 22 of the feeding tray 20, and feeds the uppermost recording paper 12 to the conveyance route 65. Note that the feeding roller 25 may rotate by receiving a driving force from a motor provided separately from the conveyance motor. Further, the driving transmitting mechanism 27 is not limited to the aspect constructed of the intermeshed gears, and may be, for example, a belt wound around the shaft 28 and around the shaft of the feeding roller 25.

<Conveyance Route 65>

As depicted in FIG. 2, the conveyance route 65 is extended from a rear-end portion of the feeding tray 20. The conveyance route 65 includes a curved portion 33 and a linear portion 34. The curved portion 33 extends while curving with a rear side thereof as an outer side of a curvature and a front side thereof as an inner side of the curvature. The linear portion 34 extends in the front-rear direction 8.

The curved portion 33 is defined by an outer guide member 18 and an inner guide member 19 which are arranged to face with each other with a predetermined gap intervened therebetween. The outer guide member 18 defines the outer side of the curvature of the curved portion 33. The inner guide member 19 defines the inner side of the curvature of the curved portion 33. Each of the outer and inner guide members 18 and 19 are provided to extend in the left-right direction 9 orthogonal to the sheet surface of FIG. 2. The linear portion 34 is defined by the recording section 24 and the platen 42, which face with each other with a predetermined gap therebetween, at a position where the recording section 24 is arranged.

The recording paper 12 supported by the feeding tray 20 is conveyed by the feeding roller 25 such that the recording paper 12 makes a U-turn from the lower portion toward the upper portion of the curved portion 33, and arrives at a conveyance roller pair 59 (to be described later on). The recording paper 12 pinched between the conveyance roller pair 59 is conveyed in the linear portion 34 in the front-rear direction 8 toward the recording section 24. When the recording paper 12 reaches at a position immediately below the recording section 24, an image is recorded on the recording paper 12 by the recording section 24. The recording paper 12, on which the image has been recorded, is conveyed in the linear portion 34 in the front-rear direction 8 and is discharged to the discharge tray 21. As described above, the recording paper 12 is conveyed in a conveyance direction 15 indicated by an arrow of a dashed-dotted line depicted in FIG. 2.

<Platen 42 and Recording Section 24>

As depicted in FIG. 2, the recording section 24 is arranged above the linear portion 34. At a position below the linear portion 34 and facing the recording section 24, a platen 42 (an example of a second supporting member of the present teaching) is arranged.

Figure 3:
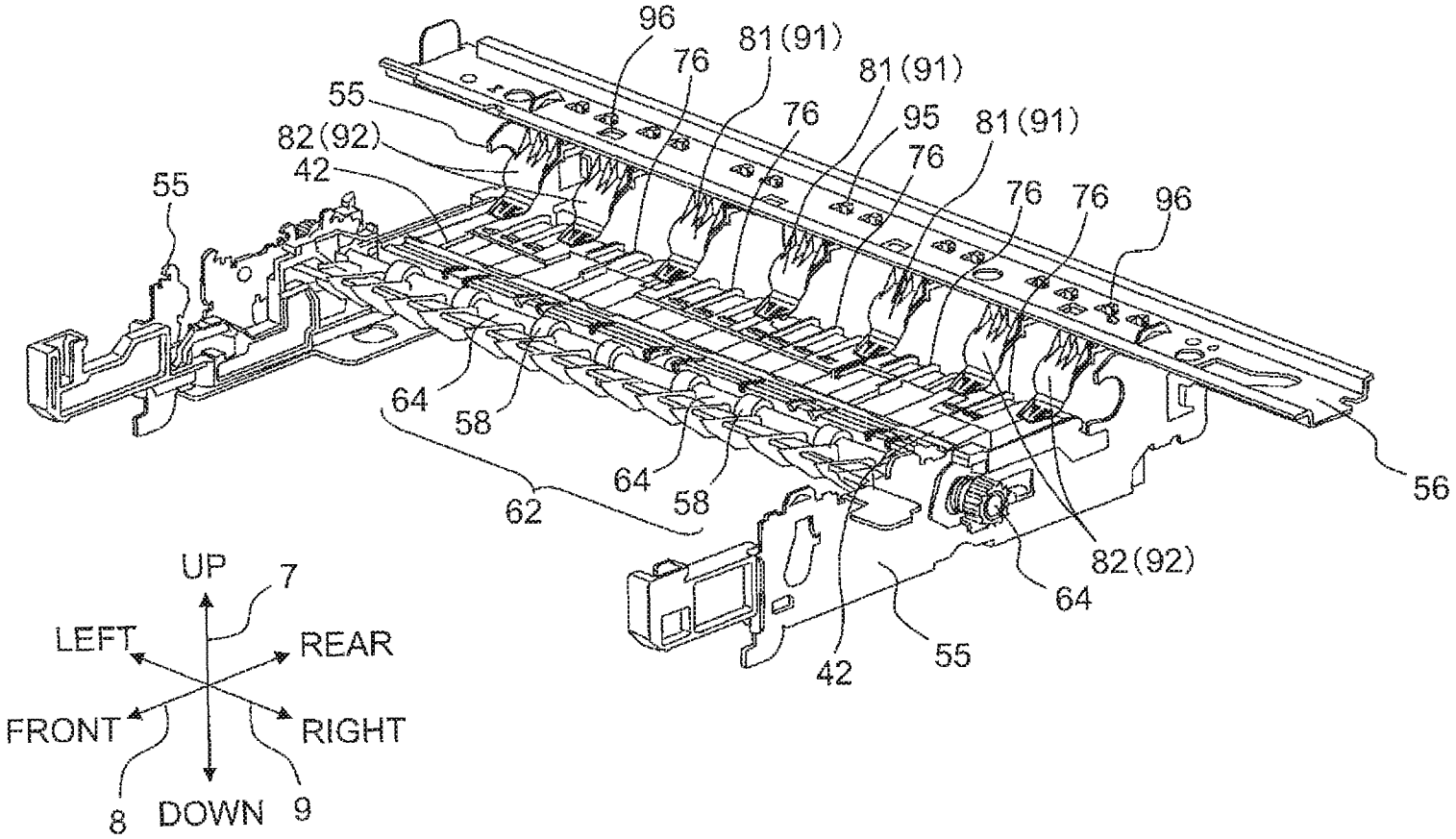
FIG. 3 is a perspective view depicting a platen, a guide rail and those in the vicinity of the platen and the guide rail.

The platen 42 is a member which has a flat plate-like shape and of which lengths in the front-rear and left-light directions 8 and 9 are longer than that in the up-down direction 7. As depicted in FIG. 3, the platen 42 is provided with a plurality of ribs 76 (an example of third abutment portions of the present teaching) which are arranged on the upper surface of the platen 42 apart from each other in the left-right direction 9 (an example of the width direction of the present teaching) orthogonal to the conveyance direction 15, and each of which extends in the front-rear direction 8. The platen 42 supports, by upper ends of the ribs 76, the recording paper 12 which is conveyed in the linear portion 34 of the conveyance route 65. Note that the platen 42 may have a shape other than the flat plate-like shape, provided that the plate 42 can support the recording paper 12.

As depicted in FIG. 2, the recording section 24 includes a carriage 40 and a recording head 38. The carriage 40 is supported by two guide rails 56 and 57 which are arranged apart from each other in the front-rear direction 8, such that the carriage 40 can reciprocate in the left-right direction 9. The guide rail 56 (an example of a first supporting member of the present teaching) is arranged upstream of the recording head 38 in the conveyance direction 15. The guide rail 56 is supported by a pair of side frames 55 (see FIG. 3) arranged respectively on the both outer sides in the left-right direction 9 of the linear portion 34 of the conveyance route 65. The guide rail 57 is arranged downstream of the recording head 38 in the conveyance direction 15. Note that the carriage 40 is moved by a driving force imparted to the carriage 40 by a carriage driving motor (not depicted in the drawings).

The recording head 38 is mounted on the carriage 40. An ink is supplied to the recording head 38 from an ink cartridge (not depicted in the drawings). Nozzles 39 are formed in the lower surface of the recording head 38. When the carriage 40 is being moved in the left-right direction 9, the recording head 38 jets or discharges ink droplets from the nozzles 39 toward the platen 42. With this, an image, etc. is recorded on the recording paper 12 conveyed in the linear portion 34 in the conveyance direction 15 and supported by the platen 42.

<Conveyance Roller Pair 59 and Discharge Roller Pair 44>

As depicted in FIG. 2, a conveyance roller pair 59 is arranged upstream in the conveyance direction 15 of the recording head 38 in the linear portion 34. A discharge roller pair 44 is arranged downstream in the conveyance direction 15 of the recording head 38 in the linear portion 34.

The conveyance roller pair 59 includes a conveyance roller 60 which is arranged below the linear portion 34 and a pinch roller 61 which is arranged above the linear portion 34 to face the conveyance roller 60. The conveyance roller 60 is a hollow cylindrical-shaped member extending in the left-right direction 9. The pinch roller 61 is included in a plurality of pinch rollers 61 provided in the left-right direction 9 at a distance from each other. Each of the pinch rollers 61 is pressed against the conveyance roller 60 by an elastic member (not depicted in the drawings) such as a coil spring, etc.

The discharge roller pair 44 includes a discharge roller 62 which is arranged below the linear portion 34 and a spur 63 which is arranged above the linear portion 34 to face the discharge roller 62. As depicted in FIG. 3, the discharge roller 62 is provided with a shaft 64 extending in the left-right direction 9 and roller sections 58 attached to the shaft 64 at a distance from each other in the left-right direction 9 so that the roller sections 58 covers portions of the shaft 64, respectively. The discharge roller 62 is rotatably supported by the pair of side frames 55. The spur 63 is included in a plurality of spurs 63 provided in the left-right direction 9 at a distance from each other. The spurs 63 are arranged at positions facing the roller sections 58, respectively, of the discharge roller pair 62. Each of the spurs 63 is pressed against one of the roller sections 58 of the discharge roller 62 by an elastic member (not depicted in the drawings) such as a coil spring, etc.

The conveyance roller 60 and the discharge roller 62 are rotated by the driving force imparted to the conveyance and discharge rollers 60 and 62 by the conveyance motor. When the conveyance roller 60 is rotated in a state that the recording paper 12 is pinched by the conveyance roller pair 59, the recording paper 12 is conveyed in the conveyance direction 15 by the conveyance roller pair 59 and is conveyed onto the platen 42. When the discharge roller 62 is rotated in a state that the recording paper 12 is pinched by the discharge roller pair 44, the recording paper 12 is conveyed in the conveyance direction 15 by the discharge roller pair 44 and is conveyed onto the discharge tray 21.

<First Abutment Member 81 and Second Abutment Member 82>

As depicted in FIGS. 2 and 3, a first abutment member 81 and a second abutment member 82 are arranged upstream in the conveyance direction 15 of the nozzles 39 formed in the recording head 38. Each of the first abutment member 81 and the second abutment member 82 is formed of a synthetic resin (for example, polyacetal (POM)). Note that each of the first abutment member 81 and the second abutment member 82 may be configured by, for example, fitting a plurality of members or components to each other.

Figure 4:
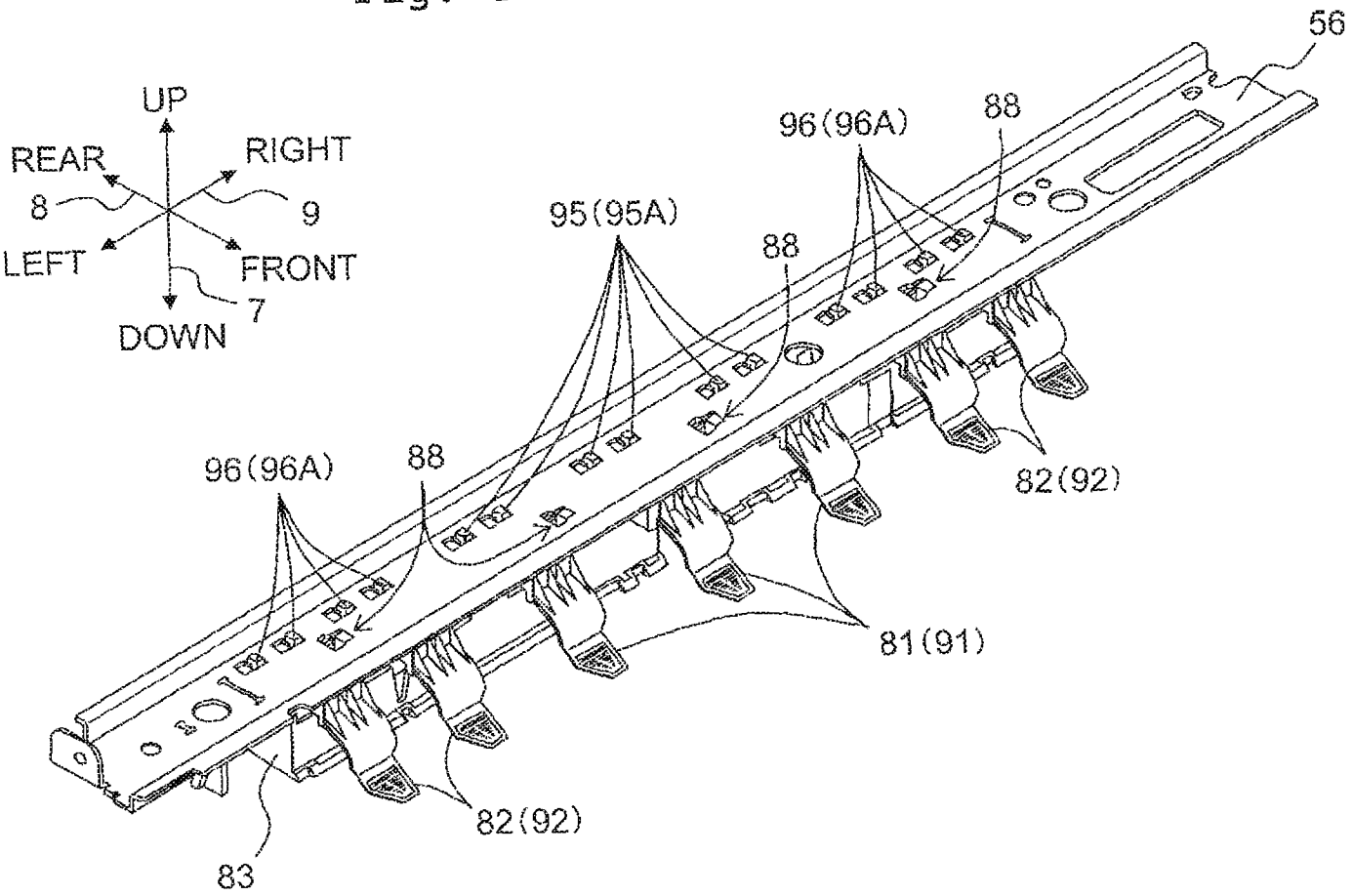
FIG. 4 is a perspective view of the guide rail, a first abutment member, a second abutment member and a pressing member.
Figure 5:
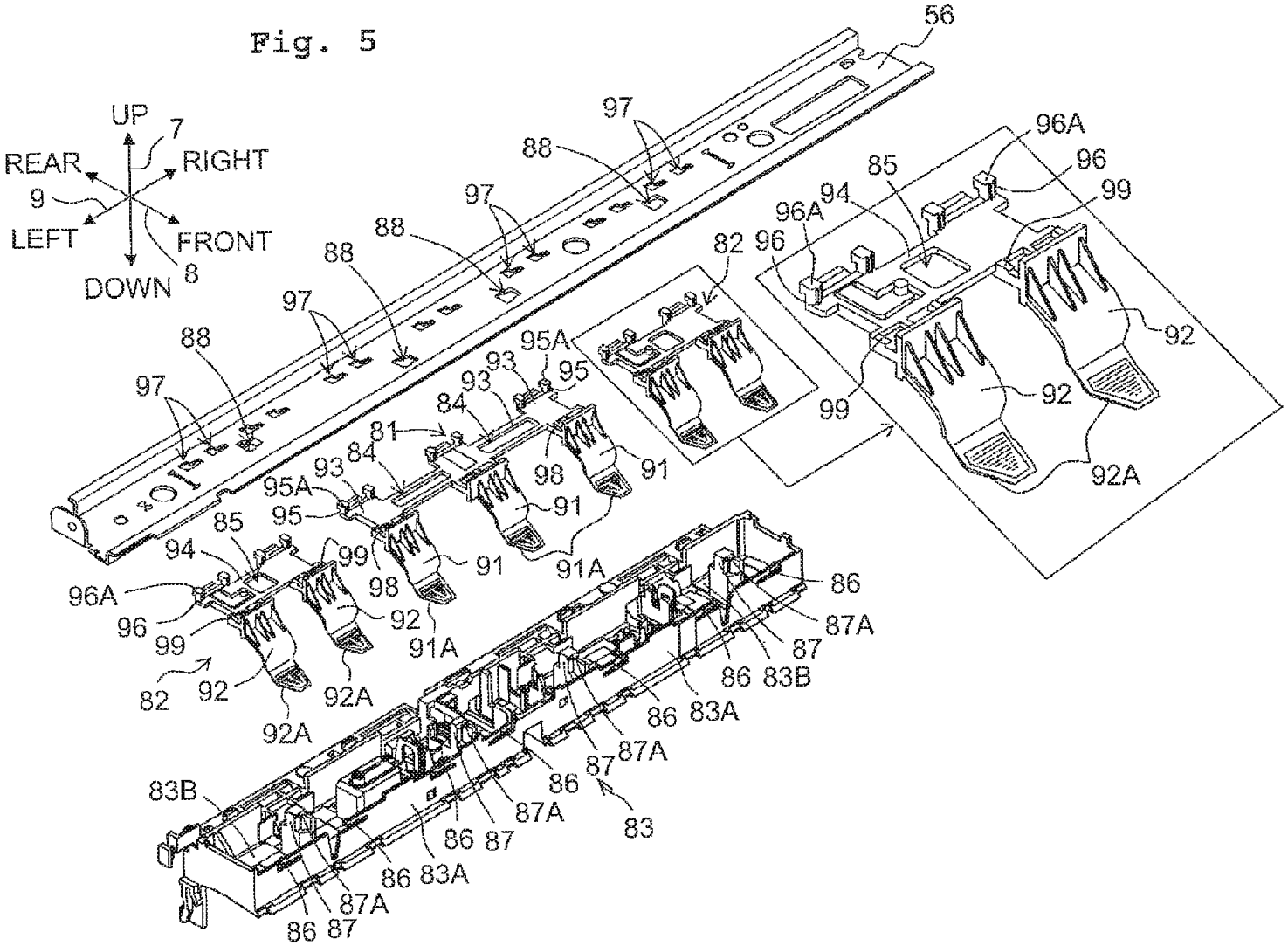
FIG. 5 is an exploded perspective view of FIG. 4.

As depicted in FIGS. 3 to 5, the first abutment member 81 is provided between two pieces of the second abutment member 82 in the left-right direction 9. Further, the first abutment member 81 and the second abutment members 82 are arranged in the left-right direction 9 apart from each other. Namely, the second abutment members 82 are arranged at the both sides, respectively, in the left-right direction 9 of the first abutment member 81, with spacing distances from the first abutment member 81.

The first and second abutment members 81 and 82 are attached to the guide rail 56. The attachment of the first and second abutment members 81 and 82 to the guide rail 56 will be explained in detail later on.

As depicted in FIGS. 2 and 5, the first abutment member 81 is provided with three first abutment portions 91 arranged upstream of the nozzles 39 in the conveyance direction 15, apart from one another in the left-right direction 9, and first connecting sections 93 connecting rear end portions (upstream end portions in the conveyance direction 15) of adjacent first abutment portions 91 among the three first abutment portions 91. Each of the first abutment portions 91 extends from a front end portion (downstream end portion in the conveyance direction 15) of one of the first connecting sections 93, while curving downward and frontward, and reaching the vicinity of the nozzles 39 on the upstream side in the conveyance direction 15.

Each of the two second abutment members 82 is provided with two second abutment portions 92 arranged upstream of the nozzles 39 in the conveyance direction 15, apart from each other in the left-right direction 9, and a second connecting section 94 connecting rear end portions of the adjacent second abutment portions 92. Each of the second abutment portions 92 extends from a front end portion of the second connecting section 94, while curving downward and frontward, and reaching the vicinity of the nozzles 39 on the upstream side in the conveyance direction 15.

As described above, the number of the first abutment portions 91 possessed by the first abutment member 81 is three, and the number of the second abutment portions 92 possessed by each of the second abutment members 82 is two. Namely, the number of the first abutment portions 91 possessed by the first abutment member 81 is greater than the number of the second abutment portions 92 possessed by each of the second abutment members 82.

Figure 6:
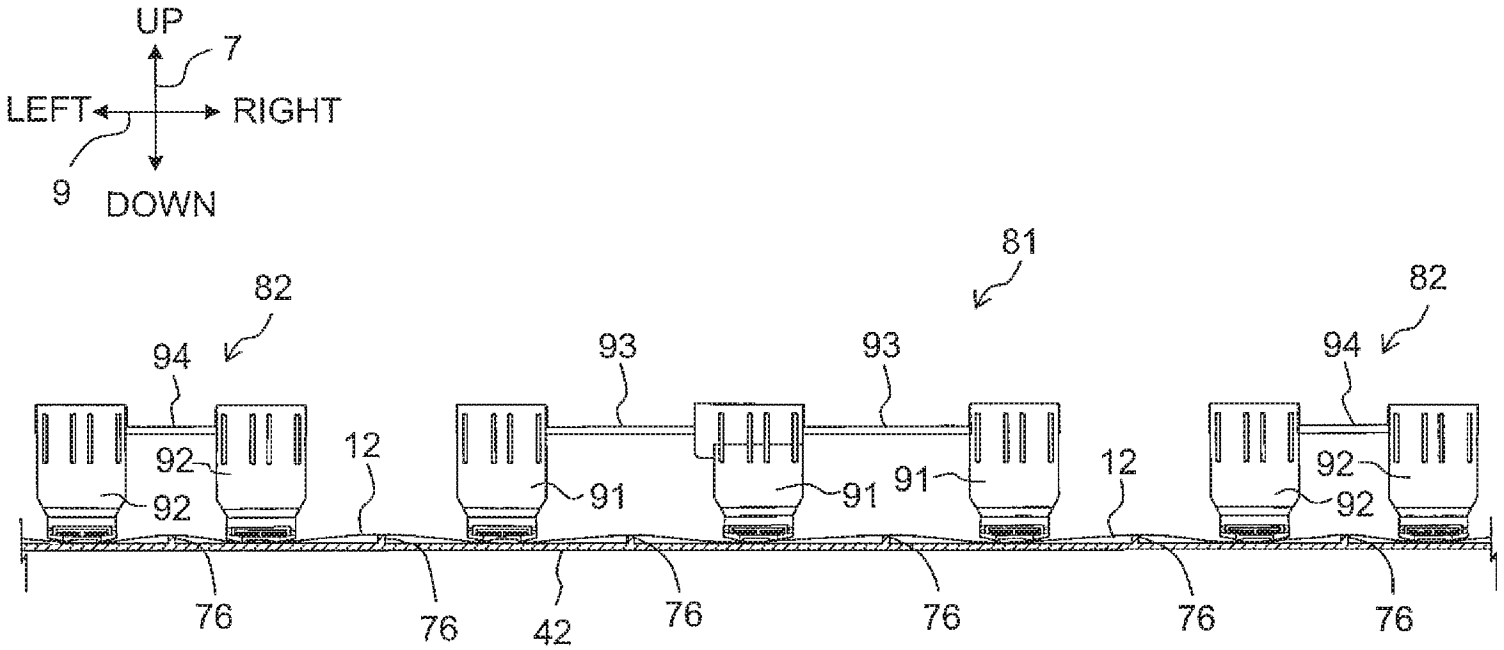
FIG. 6 is a cross-sectional view schematically depicting the first abutment member, the second abutment member, the platen and a recording sheet.

As depicted in FIG. 6, the first and second abutment portions 91 and 92 are arranged between the adjacent ribs 76 formed in the platen 42. Forward ends (portions on the downstream side in the conveyance direction 15) of the first and second abutment portions 91 and 92 abut against the upper surface of the recording paper 12 conveyed in the linear portion 34. Lower ends of the first and second abutment portions 91 and 92 are located below the upper ends of the ribs 76. With this, a waving shape continued in the left-right direction 9 is imparted to the recording paper 12. Note that the height relationship between the lower ends of the first and second abutment portions 91 and 92 and the upper ends of the ribs 76 may be other than the above-described relationship, provided that the wave-like shape can be imparted to the recording paper 12. As described above, the ribs 76 cooperate with the first and second abutment portions 91 and 92 so as to impart the wave-like shape to the recording paper 12.

In the embodiment, the distances in the up-down direction 7 between the recording section 24 (specifically, the lower end of the recording head 38) and respective abutment areas 91A, 92A, of the first and second abutment portions 91 and 92, which abut against the recording paper 12 are identical. Further, the extending lengths of the abutment areas 91A, 92A toward the downstream side of the conveyance direction 15 are identical.

In each of the first connecting sections 93, a portion between the adjacent abutment portions 91 (a portion different from the adjacent abutment portions 91 in the left-right direction 9; hereinafter referred to as a "first portion") is slenderer than other portions (portions corresponding to the adjacent first abutment portions 91 in the left-right direction 9; hereinafter referred to as a "second portion"). Similarly, in each of the second connecting sections 94, a portion between the adjacent abutment portions 92 (a portion different from the adjacent abutment portions 92 in the left-right direction 9; hereinafter referred to as the "first portion") is slenderer than other portions (portions corresponding to the adjacent second abutment portions 92 in the left-right direction 9; hereinafter referred to as the "second portion"). In this embodiment, the first portion is slenderer than the second portion because an opening 84 or 85 is formed in the first portion.

The first and second abutment members 81 and 82 are supported by the guide rail 56, as described in detail later on.

As depicted in FIG. 5, a plurality of projections 95 are formed on the upper surface of the first connecting section 93, at a rear end portion thereof, so that the projections 95 are arranged apart from each other in the left-right direction 9. Further, a plurality of projections 96 are formed on the upper surface of the second connecting section 94, at a rear end portion thereof, so that the projections 96 are arranged apart from each other in the left-right direction 9. Bent portions 95A and 96A, each of which is bent rearward, are formed on upper end portions of the projections 95 and 96, respectively. Note that in the embodiment, although the first abutment member 81 is provided with six pieces of the projection 95 and each of the second abutment members 82 is provided with four pieces of the projection 96, the numbers of the projections 95 and 96 are not limited to 6 and 4, respectively.

A plurality of openings 97 is formed on a rear portion of the guide rail 56. Each of the openings 97 is formed at a position corresponding to one of the projections 95 or 96. In each of the openings 97, the left side is longer in the front-rear direction 8 than the right side. With this, the bent portion 95A (upper end portion) of each of the projections 95 and the bent portion 96A (upper end portion) of each of the projections 96 can be inserted into the left side of the opening 97 but cannot be inserted into the right side of the opening 97. On the other hand, another portion, of each of the projections 95 and 96, which is different from the bent portion 95A or 96A (a portion closer to the base end portion than the upper end portion of each of the projections 95 and 96) can be inserted into both of the left and right sides of the opening 97.

The first abutment member 81 and the second abutment members 82 are attached to the guide rail 56 in a manner as described in detail below. Each of the projections 95 and 96 is inserted into the left side of one of the openings 97. In this situation, the projections 95 and 96 are inserted into the openings 97, respectively, so that the bent portions 95A and 96A are positioned above the guide rail 56. Afterwards, the first and second abutment members 81 and 82 are slid rightward. By doing so, the connecting sections 93 and 94 (specifically, the bent portions 95A and 96A formed in the connecting sections 93 and 94, respectively) are supported by the guide rail 56, as depicted in FIG. 4. Namely, the first and second connecting members 81 and 82 are supported by the guide rail 56.

Figure 7:
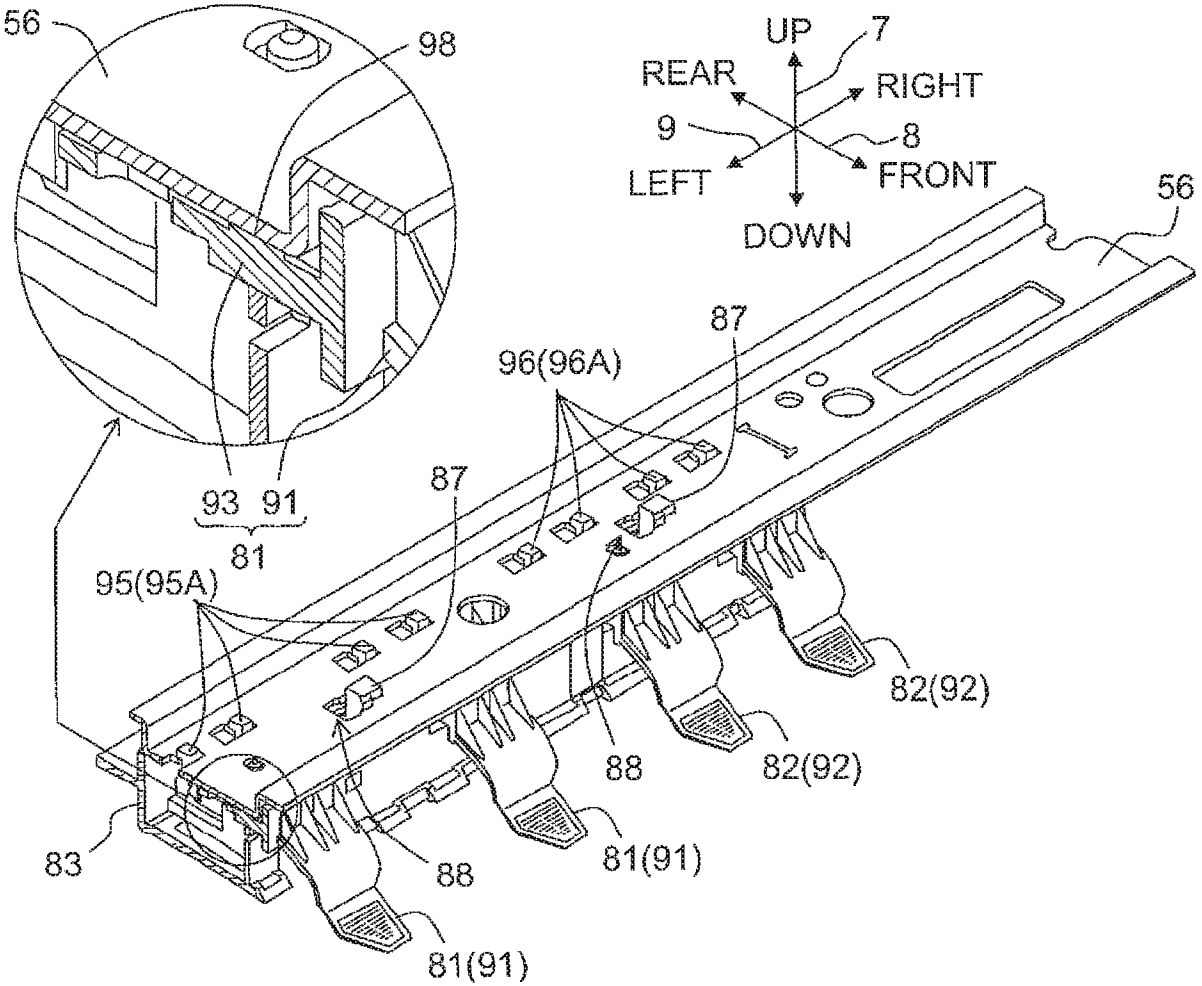
FIG. 7 is a perspective view depicting a right-side portion of FIG. 4.

In a state that the first and second abutment members 81 and 82 are supported by the guide rail 56, the first and second abutment members 81 and 82 are pressed from therebelow by a pressing member 83, as will be described in detail in the following. With this, projections 98 and projections 99 (see FIGS. 5 and 7) which are formed on the upper surfaces of the first and second connecting sections 93 and 94 at front end portions thereof, respectively, are pressed against the guide rail 56 from therebelow (see FIG. 7).

As depicted in FIG. 4, the pressing member 83 is arranged below the first and second abutment members 81 and 82. As depicted in FIG. 5, the pressing member 83 is a member having a substantially box-like shape which is elongated in the left-right direction 9 and of which upper portion is open.

As depicted in FIG. 5, urging sections 86 and projections 87 are formed in the pressing member 83. The urging sections 86 are formed at an upper end portion of a front side wall 83A of the pressing member 83. The urging sections 86 (7 pieces in this embodiment) are arranged apart from each other in the left-right direction 9. The urging sections 86 are provided corresponding to the first abutment portions 91 and to the second abutment portions 92, respectively. Portions, in the upper end portion of the front side wall 83A, at which the urging sections 86 are formed, are substantially at the same locations in the front-rear direction 8 as those of the projections 98 and 99 formed in the connecting sections 93 and 94, respectively. Each of the urging sections 86 is a section configured to bend or warp in the up-down direction 7 due to a cutout formed in the upper end portion of the front side wall 83A, as depicted in FIG. 5.

The projections 87 extend upward from a bottom wall 83B of the pressing member 83. Four pieces of the projections 87 are formed apart from one another in the left-right direction 9. A bent portion 87A which is bent frontward is formed in each of the projections 87, at an upper end portion thereof. Note that the number of the projections 87 is not limited to 4.

Four openings 88 are formed in a front portion of the guide rail 56. Each of the openings 88 is formed at a position corresponding to one of the projections 87. The left side of each of the openings 88 is elongated in the front-rear direction 8 to be longer than the right side thereof. With this, the bent portion 87A of each of the projections 87 (the upper end portion of each of the projections 87) can be inserted into the left side of one of the openings 88, but cannot be inserted into the right side of one of the openings 88. On the other hand, another portion, of each of the projections 87, which is different from the bent portion 87A (a portion closer to the base end portion than the upper end portion of each of the projections 87) can be inserted into both of the left and right sides of one of the openings 88.

After the projections 87 are inserted into the openings 88, respectively, the pressing member 83 is slid rightward. By doing so, the pressing member 83 is attached to the guide rail 56. Since a procedure for attaching the pressing member 83 to the guide rail 56 is similar to the procedure for attaching the first and second abutment members 81 and 82 to the guide rail 56, any explanation therefor more detailed than the above will be omitted here. In a state that the pressing member 83 is attached to the guide rail 56, the pressing member 83 is supported by the guide rail 56.

In a process for allowing the pressing member 83 to be attached to the guide rail 56, the urging sections 86 press the connecting sections 93 and 94 from therebelow. With this, the urging sections 86 bend downward by the reaction force from the connecting sections 93 and 94. On the other hand, the upward urging force from the urging sections 86 acts on the connecting sections 93 and 94. As a result, in a state that the pressing member 83 is attached to the guide rail 56, the projections 98 and 99 formed in the connecting sections 93 and 94, respectively, are pressed against the guide rail 56 from therebelow.

As described above, the first and second abutment members 81 and 82 are supported by the guide rail 56 in a state that the first and second abutment members 81 and 82 are positioned, relative to the guide rail 56, at a plurality of locations where the projections 95, 96 and the projections 98, 99 are arranged, respectively.

Effects of the Embodiment

According to the embodiment, since the first abutment member 81 and the second abutment members 82 are arranged separately and independently from each other, no load for moving the second abutment portions 92 is generated with respect to a recording paper 12 which makes contact only with the first abutment portions 91. Further, since the plurality of first abutment portions 91 are provided in the first abutment member 81, any variation hardly occurs in the contact positions of the plurality of first abutment portions 91 with respect to the recording paper 12.

Further, according to the embodiment, the number of the first contacting sections 91 possessed by the first abutment member 81 is greater than the number of the second abutment portions 92 possessed by each of the second abutment members 82. Further, a plurality of recording papers 12 having various sizes with mutually different widths are each conveyed with the central portion of the conveyance route 65 in the left-right direction 9 as the reference, and the plurality of the first abutment portions 91 which abut commonly against the recording papers 12 having various sizes are integrally molded. Therefore, the abutment positions of the plurality of first abutment portions 91 are stabilized with respect to these recording papers 12 having various sizes.

Furthermore, according to the embodiment, since the first abutment member 81 and the second abutment members 82 are each integrally molded of a synthetic resin, the first abutment member 81 and the second abutment members 82 may be produced easily and inexpensively.

Moreover, according to the embodiment, the first connecting sections 93 are supported by the guide rail 56. Accordingly, when the first connecting sections 93 are positioned relative to the guide rail 56 and the first abutment portions 91 abut against the recording paper 12, only the first abutment portions 91 are easily moved due to the reaction force from the recording paper 12. Further, since both of the first connecting sections 93 and the recording section 24 are positioned relative to the guide rail 56, it is possible to improve the positional accuracy of the recording paper 12, against which the first abutment portions 91 abut, with respect to the recording section 24.

Furthermore, according to the embodiment, the ribs 76 cooperate with the first abutment portions 91 so as to impart the waving shape to the recording paper 12 in the left-right direction 9.

Moreover, according to the embodiment, the first abutment portions 91 and the second abutment portions 92 are located upstream in the conveying direction 15 of the nozzles 39 configured to discharge the ink droplets. Since the recording paper 12 is pressed by the first and second abutment portions 91 and 92, cockling or floating due to the ink droplets adhered to the recording paper 12 hardly occurred.

[First Modification]

In the above-described embodiment, the distances in the up-down direction 7 between the recording section 24 and the abutment areas 91A of the first abutment portions 91 are identical. It is allowable, however, that the distances in the up-down direction 7 between the recording section 24 and the abutment areas 91A of the first abutment portions 91 are different.

Figure 10A:
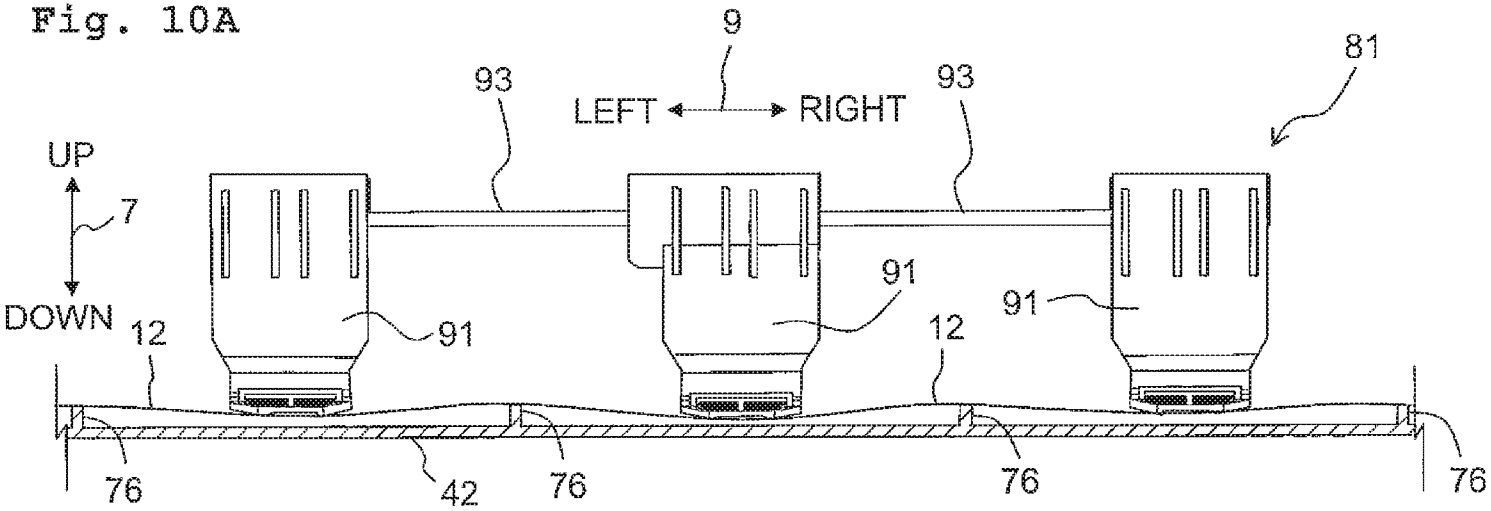
FIG. 10A is a cross-sectional view depicting the first abutment member, the platen and the recording sheet in a first modification.

For example, as depicted in FIG. 10A, the abutment area 91A of the central first abutment portion 91, which is possessed by the first abutment member 81 and which is located at the center in the left-right direction 9, may be located farther away from the recording section 24 than the abutment areas 91A of other first abutment portions 91 possessed by the first abutment member 81. In other words, the abutment area 91A of the central first abutment portion 91, which is located at the center in the left-right direction 9 in the first abutment member 81, may be arranged closer to the platen 42 than the abutment areas 91A of the other first abutment portions 91 possessed by the first abutment member 81.

According to the above example, the first abutment portion 91, located at the center in the left-right direction 9 of the recording paper 12 applies a greater load to the recording paper 12 than the load applied to the recording paper 12 by the other first abutment portions 91. Therefore, the central position in the left-right direction 9 of the recording paper 12 is stabilized.

Further, in the above-described embodiment, the distances in the up-down direction 7 between the recording section 24 and the abutment areas 92A of the second abutment portions 92 are identical. However, the distances in the up-down direction 7 between the recording section 24 and the abutment areas 92A of the second abutment portions 92 may be different, in a similar manner as with the case of the first abutment portions 91.

[Second Modification]

In the above-described embodiment, the extending lengths of the abutment areas 91A, of the first abutment portions 91, toward the downstream side of the conveyance direction 15 are identical. However, the extending lengths of the abutment areas 91A may be different.

Figure 10B:
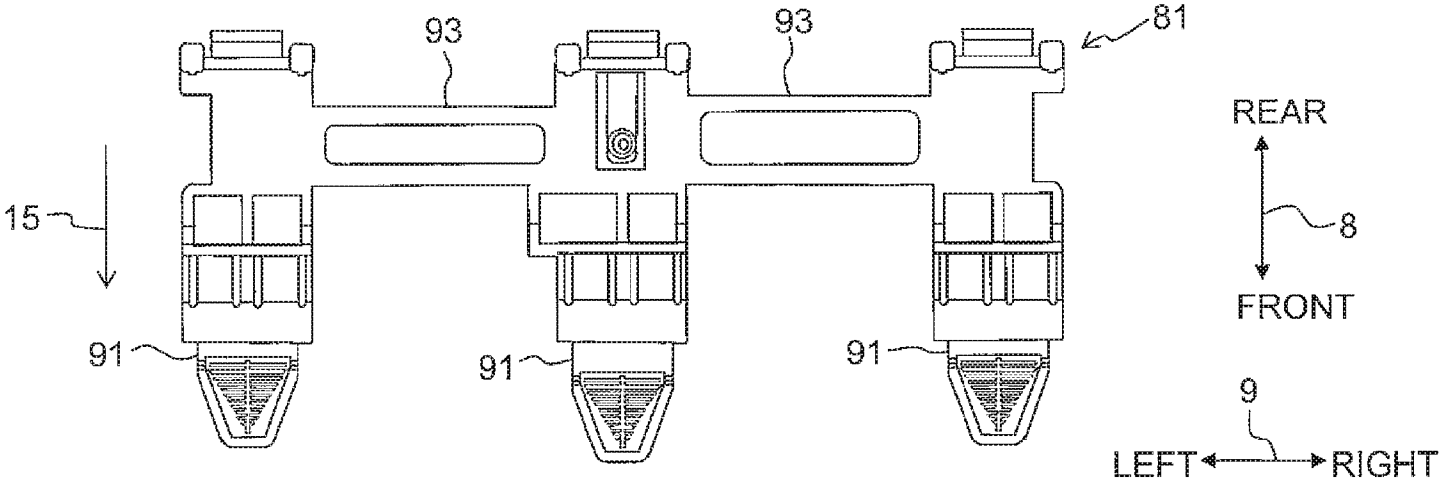
FIG. 10B is a plane view schematically depicting the first abutment member in a second modification.

For example, as depicted in FIG. 10B, it is allowable that the abutment area 91A of the central first abutment portion 91, which is located at the center in the left-right direction 9 of the first abutment member 81, is extended further to the downstream side in the conveyance direction 15 than the abutment portions 91A of other first abutment portions 91 possessed by the first abutment member 81.

According to the above example, the rear end portion of the recording paper 12 passes the plurality of first abutment portions 91 in a state that only the central first abutment portion 91 abuts against the recording paper 12. Thus, the central position in the left-right direction 9 of the recording paper 12 is stabilized.

In the above-described embodiment, the extending lengths of the abutment areas 92A of the second abutment portions 92 toward the downstream side of the conveyance direction 15 are identical. However, the extending lengths of the abutment areas 92A may be different, in a similar manner as with the case of the first abutment portions 91.

[Third Modification]

In the above-described embodiment, the connecting sections 93 and 94 connect the respective abutment portions 91 and 92 at the rear end portions of the abutment portions 91 and 92, respectively. However, the connecting sections 93 and 94 may connect the respective abutment portions 91 and 92 at portions which are different from the rear end portions of the abutment portions 91 and 92, respectively.

Figure 8:
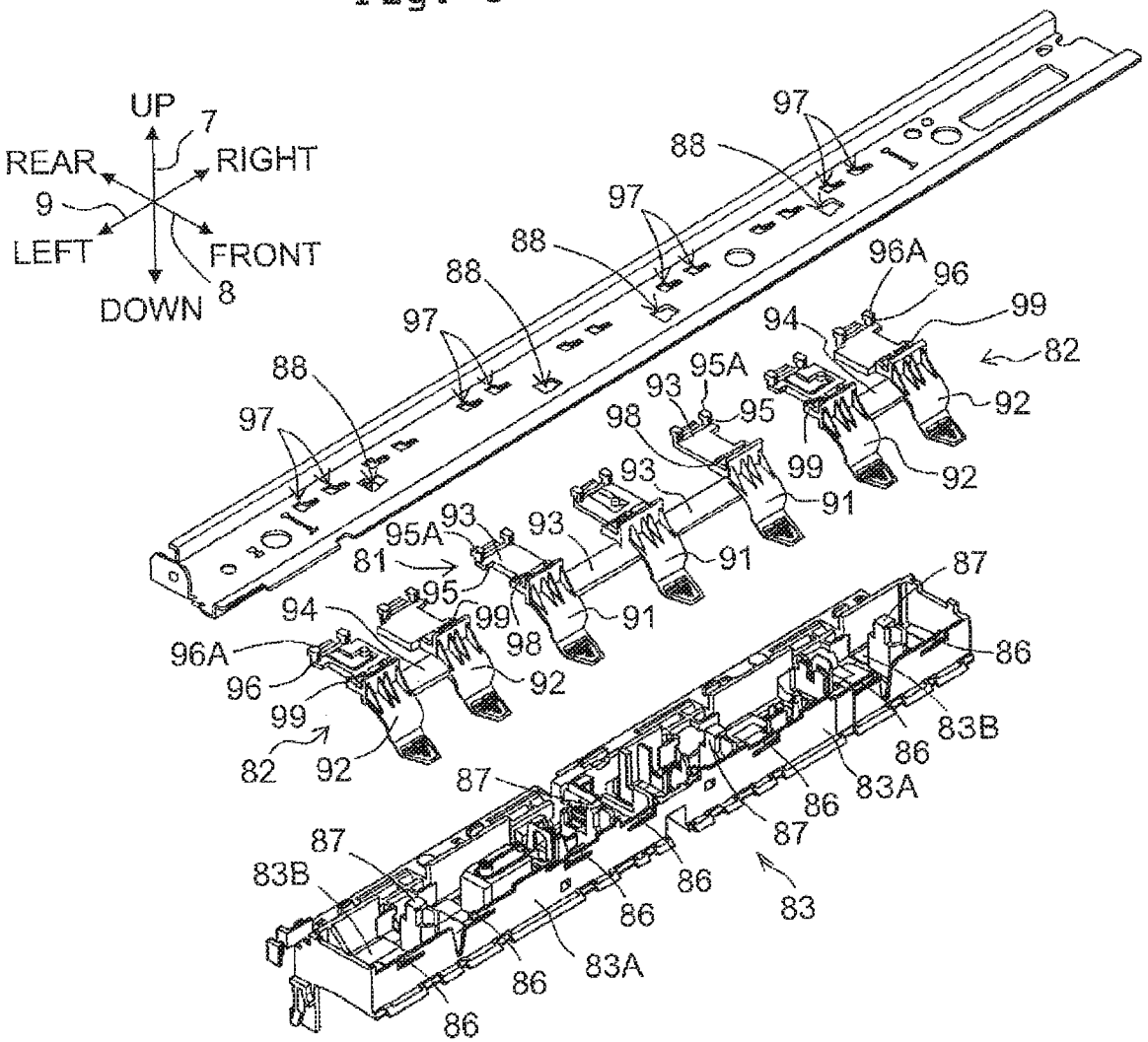
FIG. 8 is an exploded perspective view depicting a guide rail, a first abutment member, a second abutment member and a pressing member in a third modification.
Figure 9:
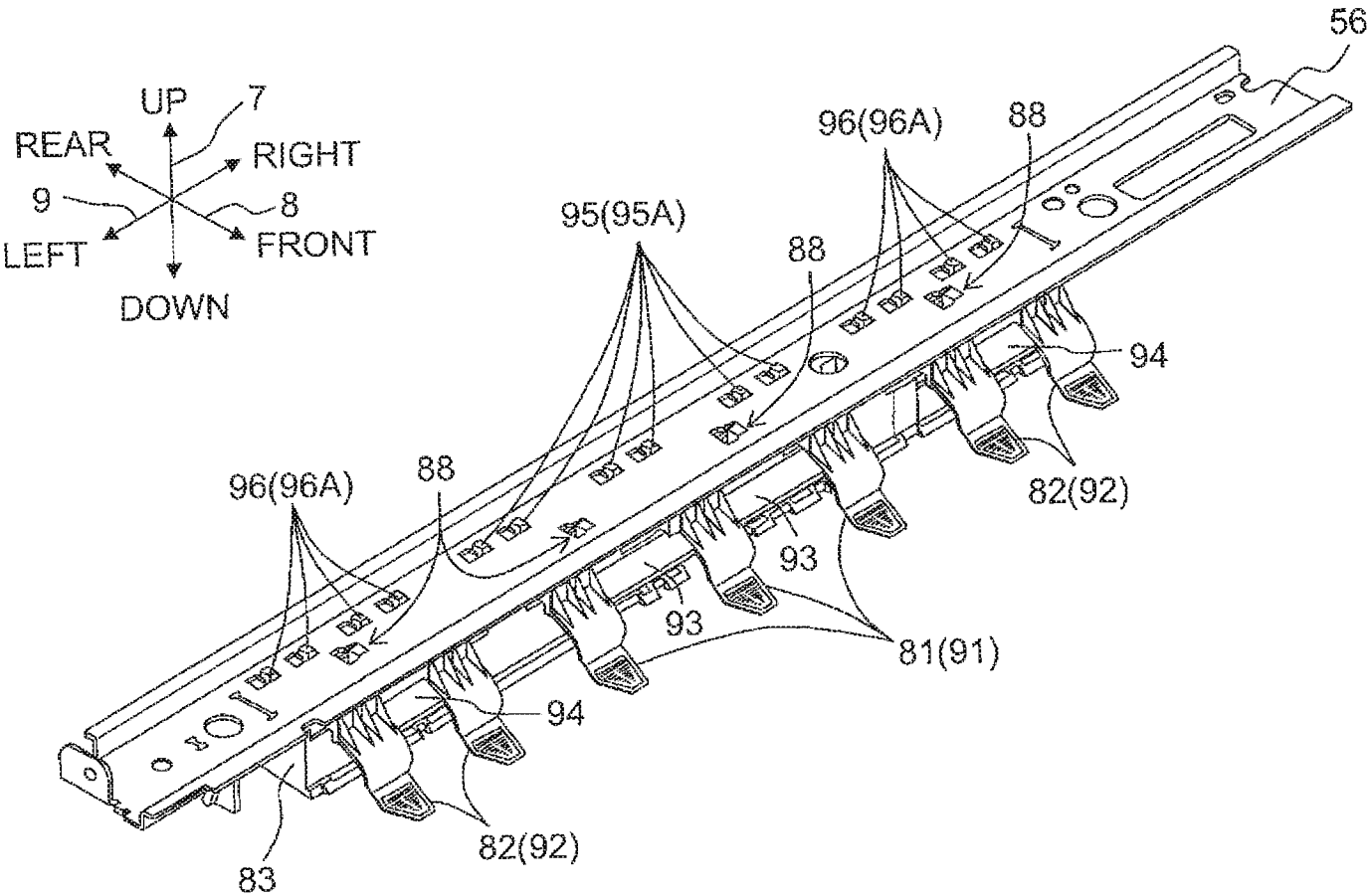
FIG. 9 is a perspective view depicting the guide rail, the first abutment member, the second abutment member and the pressing member in the third modification.

For example, as depicted in FIG. 8, the connecting sections 93 and 94 may connect the respective abutment portions 91 and 92 at portions, of the abutment portions 91 and 92 respectively, in front of the rear end portions of the abutment portions 91 and 92. In this case, the projections 95 and 96 are formed at the rear end portions of the abutment portions 91 and 92, respectively. Further, as depicted in FIG. 9, the rear end portions of the abutment portions 91 and 92 are attached to the guide rail 56.

[Other Modifications]

In the above-described embodiment, two pieces of the second abutment members 82 are provided, and the two pieces of the second abutment members 82 are arranged at the left and right sides, respectively, of the first abutment member 81. However, the number of the second abutment members 82 is not limited to two, provided that a plurality of pieces of the second abutment member 82 is provided. For example, two pieces of the second abutment member 82 may be arranged at each of the left and right sides of the first abutment member 81.

In the above-described embodiment, three pieces of the first abutment portions 91 are provided. However, the number of the first abutment portions 91 is not limited to three, provided that a plurality of pieces of the first abutment portions 91 is provided. For example, two pieces or not less than four pieces of the first abutment portions 91 may be provided.

In the above-described embodiment, two pieces of the second abutment portions 92 are provided in each of the second abutment member 82. However, at least one second abutment portion 92 is necessary to be provided in each of the second abutment members 82, and one piece or not less than three pieces of the second abutment portions 92 may be provided in each of the second abutment members 82. Note that in a configuration wherein only one piece of the second abutment portion 92 is provided in each of the second abutment members 82, there is no need to provide the second connecting section 94 for each of the second abutment members 82.

In the above-described embodiment, the number of the first abutment portions 91 possessed by the first abutment member 81 is greater than the number of the second abutment portions 92 possessed by each of the second abutment members 82. However, the number of the first abutment portions 91 possessed by the first abutment member 81 may be the same or smaller than the number of the second abutment portions 92 possessed by each of the second abutment members 82, provided that the first abutment member 81 is provided with a plurality of pieces of the first abutment portions 91.

In the above-described embodiment, each of the urging sections 86 is formed of the cutout formed in the upper end portion of the front side wall 83A of the pressing member 83. However, the configuration of the urging sections 86 is not limited to this. For example, each of the urging sections 86 may be constructed of a spring attached to an upper end portion of the front side wall 83A, and an abutment piece attached to the upper end portion of the spring to abut against one of the connecting sections 93 and 94 from therebelow. In this case, the abutment piece can urge the connecting section 93 or 94 upward by the urging force of the spring.

What is claimed is:

1. An image recording apparatus comprising:

a roller pair configured to nip a sheet therebetween and convey the sheet in a conveyance route in a conveyance direction;

a recording section provided downstream of a nip point of the roller pair in the conveyance direction and configured to record an image on the sheet conveyed in the conveyance route;

a first abutment member having a plurality of first abutment portions arranged apart from each other in a width direction orthogonal to the conveyance direction, and configured to abut against the sheet conveyed in the conveyance route, wherein the plurality of first abutment portions is positioned downstream of the nip point of the roller pair in the conveyance direction; and a second abutment member arranged apart from the first abutment member in the width direction, having a plurality of second abutment portions arranged apart from each other in the width direction, and configured to abut against the sheet conveyed in the conveyance route, wherein the plurality of second abutment portions is positioned downstream of the nip point of the roller pair in the conveyance direction, and wherein a number of the plurality of first abutment portions of the first abutment member is greater than a number of the plurality of second abutment portions of the second abutment member.

2. The image recording apparatus according to claim 1, wherein the first abutment member and the second abutment member are each integrally molded of a synthetic resin.

3. The image recording apparatus according to claim 1, further comprising a supporting member configured to support the first abutment member and the second abutment member.

4. The image recording apparatus according to claim 3, wherein the supporting member supports the recording section.

5. The image recording apparatus according to claim 4, wherein the first abutment member has a connecting section connecting the plurality of first abutment portions with each other, and the connecting section is supported by the supporting member.

6. The image recording apparatus according to claim 1, further comprising a supporting member arranged to face the first abutment member and configured to support the sheet conveyed in the conveyance route, wherein the supporting member has a plurality of ribs arranged apart from each other in the width direction, and the plurality of ribs is configured to support the sheet at upper ends thereof and to cooperate with the plurality of first abutment portions to impart a wave-like shape to the sheet.

7. The image recording apparatus according to claim 1, further comprising a supporting member arranged to face the first abutment member and configured to support the sheet conveyed in the conveyance route, wherein each of the plurality of first abutment portions has an abutment area to be abutted against the sheet, and the abutment area of a central first abutment portion in the width direction of the first abutment member is located closer to the supporting member than the abutment area of another first abutment portion of the first abutment member.

8. The image recording apparatus according to claim 1, wherein each of the plurality of first abutment portions has an abutment area to be abutted against the sheet, and the abutment area of a central first abutment portion in the width direction of the first abutment member is extended further to a downstream side in the conveyance direction than the abutment area of another first abutment portion of the first abutment member.

9. The image recording apparatus according to claim 1, wherein the recording section is configured to record the image on the sheet by jetting ink droplets from nozzles.

10. The image recording apparatus according to claim 9, wherein the plurality of first abutment portions and the plurality of second abutment portions are located upstream of the nozzles in the conveyance direction.

11. The image recording apparatus according to claim 1, further comprising a third abutment member arranged apart from the first abutment member and the second abutment member in the width direction, having a plurality of third abutment portions arranged apart from each other in the width direction, and configured to abut against the sheet conveyed in the conveyance route, wherein the plurality of third abutment portions is positioned downstream of the nip point of the roller pair in the conveyance direction, and wherein the number of the plurality of first abutment portions of the first abutment member is greater than a number of the plurality of third abutment portions of the third abutment member, wherein the second abutment member is positioned at one side in the width direction with respect to the first abutment member, and wherein the third abutment member is positioned at the other side in the width direction with respect to the first abutment member.

12. The image recording apparatus according to claim 11, wherein the number of the plurality of second abutment portions of the second abutment member and the number of the plurality of third abutment portions of the third abutment member are the same.

* * * * *